United States Patent [19]

Meyer et al.

[11] 4,014,251

[45] Mar. 29, 1977

[54] CRAFT DEVICE FOR MAKING AERIAL PROJECTILES FROM SHEET MATERIAL

[75] Inventors: Burton C. Meyer, Downers Grove; Leigh Copeland, Chicago, both of Ill.

[73] Assignee: Marvin Glass & Associates, Chicago, Ill.

[22] Filed: Nov. 10, 1975

[21] Appl. No.: 630,720

[52] U.S. Cl. ..... 93/1 R; 46/79; 93/58 ST; 93/58 H; 100/234

[51] Int. Cl.[2] ..... B31D 5/02

[58] Field of Search ..... 46/79, 81; 93/1 R, 58 ST, 93/58 H, 58 P, 58 R; 100/234; 30/358, 359, 363, 366; 33/174 B, 13, 17 R, 1 B, 1 F

[56] References Cited

UNITED STATES PATENTS

| | | | |
|---|---|---|---|
| 1,999,314 | 4/1935 | Anderson | 93/58 H X |
| 2,149,913 | 3/1939 | Gilpin | 83/30 X |
| 2,741,166 | 4/1956 | Weirich et al. | 93/58 H UX |
| 3,520,220 | 7/1970 | Acker | 83/660 X |
| 3,540,149 | 11/1970 | Lowe | 46/79 |

*Primary Examiner*—James F. Coan

[57] ABSTRACT

A craft device for use in constructing aerial projectiles and in particular, paper airplanes. The device includes a press having a lower die portion and an upper die portion pivotally connected thereto along one edge. A plurality of detents or protrusions on the lower die portion are provided in alignment with complementary holes in the upper die portion and serve to perforate a suitable sheet of material such as paper to define a plurality of fold lines on the sheet. The device includes a template alignable on the sheet so that a particular design or coloration can be applied to the sheet to add realistic characteristics to the projectile. A nose piece is frictionally secured to one edge of the sheet to maintain the folds and add a predetermined amount of weight to aid in flight control.

9 Claims, 7 Drawing Figures

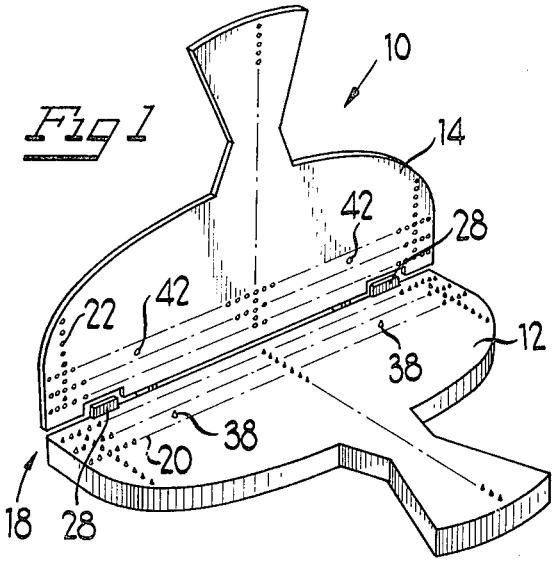
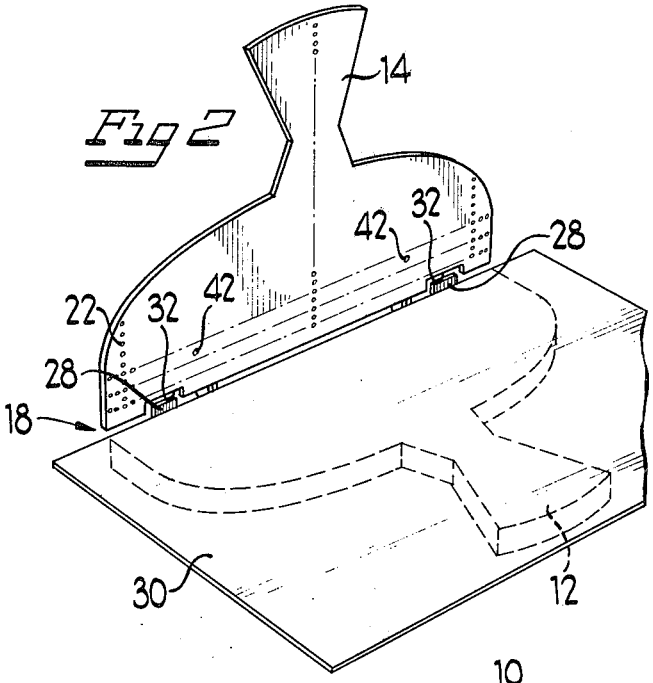
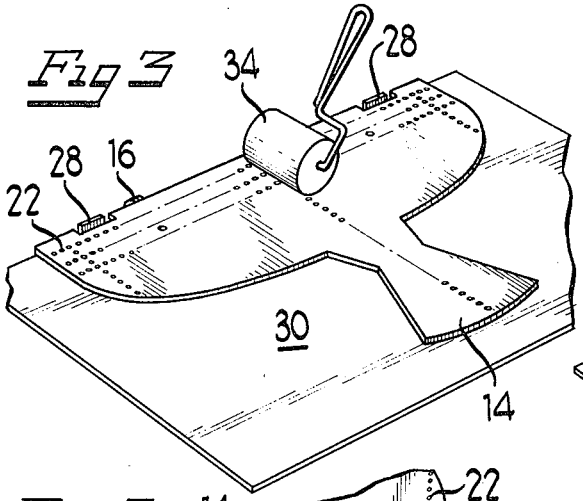
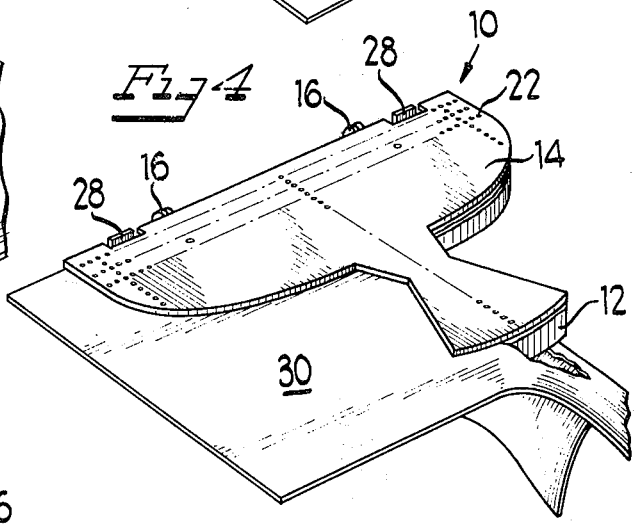
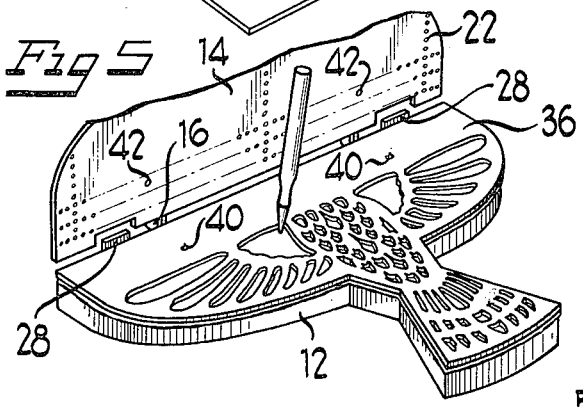
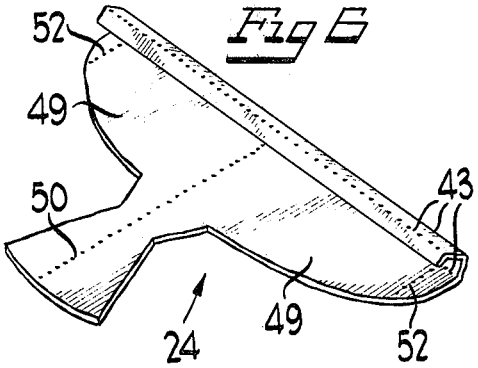
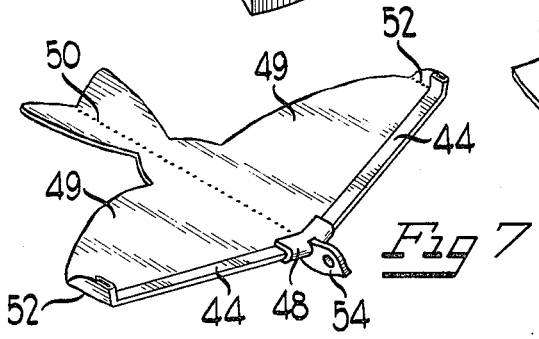
Fig 7

CRAFT DEVICE FOR MAKING AERIAL PROJECTILES FROM SHEET MATERIAL

BACKGROUND OF THE INVENTION

1. Field of the Invention

This invention relates to art and craft devices and in particular to a device for use in constructing model airplanes.

2. Description of the Prior Art

In recent years, devices which enable generally unskilled and amateur artists to participate in various arts and crafts have been well received by the public. Many of such devices are simply machines or kits which facilitate reproducing a design, or the like, which is pleasing to the eye, while the device itself is very simple to operate. Other types of craft kits require a great degree of skill to operate to produce a finished product and therefore many persons have been discouraged from attempting to utilize these devices.

SUMMARY OF THE INVENTION

The apparatus of the present invention is designed for use in constructing model aerial projectiles such as paper airplanes. The apparatus includes a press having a lower die portion and a complementarily shaped upper die portion pivotally connected thereto. A plurality of pointed detents are provided on the lower die portion and are in alignment with a complementary set of holes in the upper die portion to deform or perforate a suitable sheet of material placed in the press to define predetermined fold lines. The apparatus includes a template and means for aligning the template with the sheet to add a predetermined, aesthetic pattern to the sheet as by coloring or painting. A nose piece is provided to maintain the sheet folded along the fold lines and to add a predetermined amount of weight for flight direction control.

BRIEF DESCRIPTION OF THE DRAWINGS

FIG. 1 is a perspective view of the press embodying the concepts of the present invention;

FIG. 2 is a perspective view, similar to FIG. 1, showing a sheet of suitable material such as paper inserted into the press;

FIG. 3 is a perspective view showing the press in its closed position, with a hand pressure roller thereon;

FIG. 4 is a perspective view, similar to FIG. 3, showing the sheet material being trimmed around the periphery of the press;

FIG. 5 is a fragmented, perspective view showing a template design being applied to the sheet;

FIG. 6 is a sequential view of the appropriately formed sheet material as being folded along the predetermined fold lines; and FIG. 7 is a perspective view of the final aerial projectile, including a nose piece attached to the front leading edge thereof.

DETAILED DESCRIPTION OF THE PREFERRED EMBODIMENT

An apparatus embodying the concepts of the present invention is shown in FIG. 1. The apparatus is in the form of a press, generally designated 10, having a lower die portion 12 and an upper complementarily shaped die portion 14. The respective die portions are pivotally connected to one another by a pair of hinges 16 (FIGS. 3 and 4) located on adjacent edges of the die portions

12 and 14 so that the press may be closed by pivoting the upper die portion 14 downwardly against the lower portion 12.

Detent means, generally designated 18, in the form of a plurality of rows of upstanding, generally sharp pins 20 on the lower die portion 12 and complementary recesses or holes 22 on the upper die portion 14 define predetermined fold lines for an aerial projectile, generally designated 24 (FIGS. 6 and 7). A pair of stop tabs 28 on the lower die portion 12 serve to assist alignment of a sheet of suitable material 30, such as paper, with the pivotal edge of the respective die portions. Rectangular cutouts 32 in the top die portion 14 provide clearance for the stop tabs 28 during closing pivotal movement of the upper die portion.

FIG. 2 shows the manner in which a suitable sheet 30 is inserted into the press which is then closed to the position as shown in FIG. 3. A roller 34 is provided to increase the pressure on the sheet 30 between the upper and lower die portions 14 and 12, respectively. The rolling of the upper die portion will assure that the detents 20 sufficiently deform or perforate the sheet 30 to clearly define the particular fold lines.

FIG. 4 shows the excess portion of the sheet 30 being trimmed about the periphery of the press 10 to provide an aerial projectile having the same peripheral shape as the complementary die portions 12 and 14. This may be accomplished either by cutting around the edges of the press 10 or merely tearing away the excess, using the die portions as a guide.

A template 36 having generally the same shape as the press can be overlaid on the sheet 30 to allow the user to transfer the template design onto the sheet by coloring, painting, or the like. Any number of templates may be provided and, as shown in FIG. 5, the template may permit decoration of the projectile with the feathers of a bird. The template is aligned on a pair of posts 38 (FIG. 1) on the lower die portion 12 which protrude into a pair of complementary apertures 40 in the template and are received in complementary recesses 42 in the upper die portion 14.

Referring to FIG. 6, the sheet 30 then is removed from the press 10 and first folded about three longitudinal fold lines 43 near the front edge of the sheet. A front reinforced edge 44 (FIG. 7) thus is formed to provide cross bracing means for the projectile. A nose piece 48 slidably receives the front edge at the center thereof to maintain the same folded and at an angle so that side wing portions 40 of the projectile slant upwardly from a longitudinal axis defined by a fold line 50 provided by the detent means 18. Additionally, the outer tip of each side wing portion is folded generally vertically along fold lines 52 formed by the detent means.

A suitable forward projection 54, such as the head of a bird, may be mounted to the nose piece 48 to complete the projectile 24 and give it the appearance of a simulated bird. The weight supplied by the folded front edge 44, nose piece 48, and projection 54, as well as the angle of the side wing portions 49, assist in the forward flight direction control of the aerial projectile 24.

The foregoing detailed description has been given for clearness of understanding only and no unnecessary limitations should be understood therefrom as some modifications will be obvious to those skilled in the art.

We claim:

1. A method for making aerial projectiles from sheet material such as paper, or the like, comprising the steps of:

providing a press having complementary means on the respective portions thereof for deforming the sheet material in a predetermined manner to define a set of fold lines;

placing the sheet material in the press;

pressurizing the press to deform the sheet material;

folding the sheet material along said predetermined fold lines to define the shape of a projectile having desired aerodynamic characteristics to sustain the projectile in flight; and trimming the sheet material about the outline of the press.

2. An apparatus for use in making aerial projectiles from sheet material, such as paper, or the like, comprising:

a press having a lower die portion and an upper die portion, said die portions being pivotally connected along one edge thereof and including complementary detent means for deforming the sheet material in a predetermined pattern so as to define fold lines about which the sheet may be folded to define the shape of a projectile having desired aerodynamic characteristics which will sustain the projectile in flight, said detent means being aligned on said upper and lower die portions for perforating the sheet material to define said fold lines.

3. A kit for use in making aerial projectiles a sheet of material such as paper, or the like; comprising:

a press having a lower die portion and a manually movable upper die portion;

complementary means on said respective die portions for deforming the sheeet material in a predetermined pattern so as to define a set of lines about which the sheet may be folded to define the shape of a projectile having desired aerodynamic characteristics which will sustain the projectile in flight; and a nose piece for attachment to the projectile to add a predetermined amount of weight thereto to aid in control of the path of flight of the projectile, said nose piece having means for clamping the sheet of material along a folded portion thereof defined by some of said set of lines.

4. An apparatus for use in making aerial projectiles or the like from sheet material such as paper having at least one peripheral straight edge therealong, comprising:

a press having a lower die portion with a straight edge along one side thereof, and a manually movable upper die portion;

complementary means on said respective die portions for deforming the sheet material in a predetermined pattern so as to define a set of lines about which the sheet may be folded to define the shape of a projectile or the like having desired aerodynamic characteristics which will sustain the projectile in flight; and means for aligning the straight peripheral edge of said sheet material between said die portions in proximity with the straight edge of said lower die portion for proper alignment of said set of lines.

5. The apparatus of claim 4 wherein said means for aligning the sheet material comprises at least one protruding stop tab on said lower die portion disposed at the straight side edge thereof.

6. An apparatus for use in making aerial projectiles from sheet material such as paper, or the like, comprising:

a press having a lower die portion and a manually movable upper die portion;

complementary means on said respective die portions for deforming the sheet material in a predetermined pattern so as to define a set of lines about which the sheet may be folded to define the shape of a projectile having desired aerodynamic characteristics which will sustain the projectile in flight; and at least one template and means for aligning the template with one of the die portions and the sheet material for applying a design to the sheet, said aligning means for the template comprising at least one pin on one of the die portions alignable with a complementary aperture in the template.

7. The apparatus of claim 6 wherein said aligning means comprises at least one pin on one of the die portions alignable with a complementary aperture in the template.

8. An apparatus for use in making aerial projectiles from sheet material such as paper, or the like, comprising:

a press having a lower die portion and a manually movable upper die portion; and complementary means on said respective die portions for deforming the sheet material in a predetermined pattern so as to define a set of lines about which the sheet may be folded to define the shape of a projectile having desired aerodynamic characteristics which will sustain the projectile in flight, said complementary means including a plurality of aligned detents on said upper and lower die portions for perforating the sheet material to define predetermined fold lines on the sheet.

9. The apparatus of claim 8 wherein said detents are arranged to define a main longitudinal axis about which the respective sides of the sheet material are folded.

* * * * *